United States Patent [19]

Röck et al.

[11] Patent Number: 4,850,080

[45] Date of Patent: Jul. 25, 1989

[54] HINGE

[75] Inventors: Erich Röck, Höchst; Klaus Brüstle; Helmut Rupprechter, both of Lauterach, all of Austria

[73] Assignee: Julius Blum Gesellschaft m.b.H., Höchst, Austria

[21] Appl. No.: 27,412

[22] Filed: Mar. 18, 1987

[30] Foreign Application Priority Data

Apr. 10, 1986 [AT] Austria ..... 936/86

[51] Int. Cl.[4] ..... E05D 7/04; E05D 7/06; E05D 7/12

[52] U.S. Cl. ..... 16/236; 16/240; 16/246; 16/258; 16/261; 16/270; 16/297; 16/302; 16/382; 16/324; 16/347; 16/349

[58] Field of Search ..... 16/238, 236, 240, 245, 16/246, 258, 261, 268, 270, 297, 302, 370, 382, 259, 324, 343, 349, 347

[56] References Cited

U.S. PATENT DOCUMENTS

| | | | |
|---|---|---|---|
| 3,969,787 | 7/1976 | Rock et al. | 16/238 |
| 4,359,802 | 11/1982 | Rock | 16/238 |
| 4,430,771 | 2/1984 | Salice | 16/235 |
| 4,586,399 | 5/1985 | Kassai | 74/551.3 |
| 4,654,932 | 4/1987 | Rock et al. | 16/382 |
| 4,750,238 | 6/1988 | Rock et al. | 16/241 |

FOREIGN PATENT DOCUMENTS

| | | | |
|---|---|---|---|
| 360856 | 2/1980 | Austria . | |
| 043903 | 5/1981 | European Pat. Off. . | |
| 145952 | 11/1984 | European Pat. Off. . | |
| 2460127 | 6/1976 | Fed. Rep. of Germany . | |
| 2614446 | 10/1976 | Fed. Rep. of Germany . | |
| 2614447 | 10/1976 | Fed. Rep. of Germany . | |
| 2719890 | 11/1977 | Fed. Rep. of Germany . | |
| 2657628 | 6/1978 | Fed. Rep. of Germany . | |
| 2806958 | 8/1978 | Fed. Rep. of Germany . | |
| 3026796 | 1/1982 | Fed. Rep. of Germany . | |
| 3039328 | 5/1982 | Fed. Rep. of Germany . | |
| 2857820 | 7/1982 | Fed. Rep. of Germany . | |
| 3119571 | 12/1982 | Fed. Rep. of Germany . | |
| 3241284 | 5/1984 | Fed. Rep. of Germany . | |
| 3302312 | 7/1984 | Fed. Rep. of Germany . | |
| 3446544 | 6/1986 | Fed. Rep. of Germany . | |
| 3500423 | 7/1986 | Fed. Rep. of Germany . | |
| 1522807 | 8/1978 | United Kingdom | 16/382 |

*Primary Examiner*—M. Jordan
*Assistant Examiner*—Edward A. Brown
*Attorney, Agent, or Firm*—Wenderoth, Lind & Ponack

[57] ABSTRACT

A hinge includes a hinge arm to be connected with a second hinge part by hinge links. The hinge arm is provided at the front thereof with a joint adjusting screw for engagement with a mounting plate. The rear of the hinge arm is provided with a clamping screw which permits a depth adjustment and extends through a rearwardly open slot in the hinge arm. The clamping screw connects the hinge arm with an intermediate member which carries a tensioning lever which is acted upon by a spring. The tensioning lever holds the intermediate member with the hinge arm on the mounting plate in a clamping arrangement.

7 Claims, 1 Drawing Sheet

HINGE

FIELD AND BACKGROUND OF THE INVENTION

The invention relates to a hinge comprising a hinge arm which is connected with a second hinge part by means of hinge links, the hinge arm being provided with a joint adjusting screw by means of which the hinge arm is, at the front thereof, engageable in a mounting plate, the hinge arm further having, at the rear thereof a clamping screw which allows a depth adjustment and extends through a preferably rearwardly open slot in the hinge arm.

DESCRIPTION OF THE PRIOR ART

A hinge of the above-described kind has for example been described in DE-PS No. 28 57 820.

Such hinges have to fulfil essentially two requirements. When the door is being engaged, the hinge arm should be quickly lockable onto the mounting plate and held thereon so that the door need not be held too long. Furthermore, one or several possibilities of adjustment should be provided to be able to compensate for any errors which have, for example, been caused by drilling the fastening holes into the pieces of furniture.

A hinge is known from DE-OS No. 26 14 446 wherein a hinge arm has a joint adjusting screw which is arranged on the side of the hinge link and by means of which the hinge arm is engageable in the mounting plate. At the rear end, the hinge arm is provided with an open slot through which extends a clamping screw which is screwed into the mounting plate. When the clamping screw is loosened, the hinge arm with the joint adjusting screw easily can be engaged in the mounting plate. The displacement path is very short.

A hinge whose hinge arm carries at its rear end a pivot lever which is acted upon by a spring is described in published European patent application No. 0145952. When the hinge arm is being mounted, the hinge arm, which is provided with projections, must be inserted with said the projections into guide grooves of the mounting plate. Locking of the hinge arm is effected by engaging the pivot lever.

SUMMARY OF THE INVENTION

It is the object of the invention to provide a hinge of the above-mentioned kind which is, according to the particular requirements, fastenable to a mounting plate in a very simple manner by means of a clamping screw or also by means of a pivot lever which is acted upon by a spring. Furthermore, the use of a pivot lever should avoid a long displacement path of the hinge arm relative to the mounting plate.

According to the invention this problem is solved in that the clamping screw connects the hinge arm with an intermediate member which is known per se and carries a tensioning lever which is acted upon by a spring and engages behind a projection of the mounting plate, thus holding the intermediate member with the hinge arm at the mounting plate in a clamping arrangement.

It is advantageously provided that the intermediate member has a centering projection which extends into a recess in the mounting plate. Such centering projection provides for a correct positioning of the hinge arm when the fastening holes for the mounting plate are correctly mounted at the furniture side wall. Furthermore, a bracing effect may be produced between the centering projection and the pivot lever, which improves the support of the hinge arm at the mounting plate.

It is advantageously provided that the tensioning lever in the intermediate member is covered towards the top and towards both sides by the structure of the intermediate member.

The spring which acts upon the tensioning lever is advantageously a leg spring.

BRIEF DESCRIPTION OF THE DRAWINGS

In the following an embodiment of the invention will be described in more detail with reference to the accompanying drawings in which.

Figure 1:
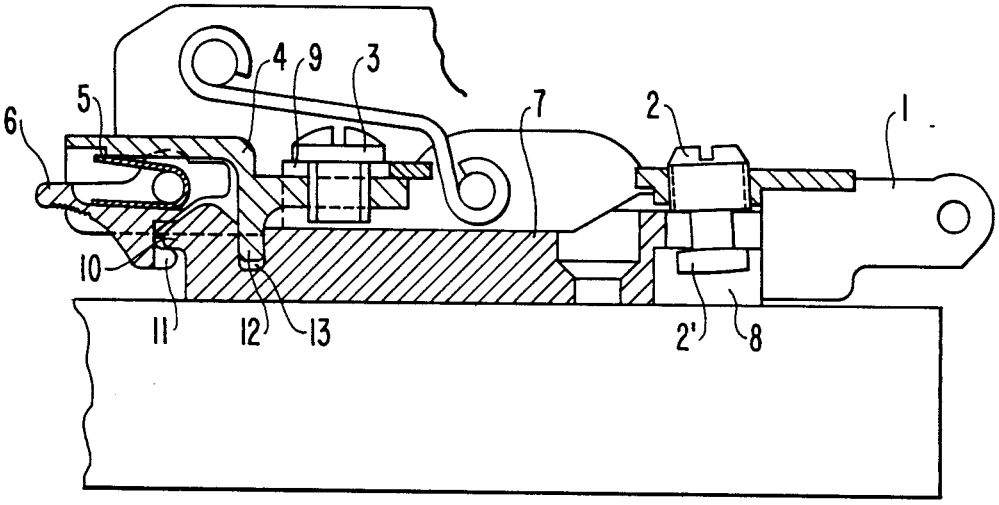
FIG. 1 is a longitudinal sectional view of the hinge arm and the mounting plate of a hinge according to the invention, taken along line I—I of FIG. 2.
Figure 2:
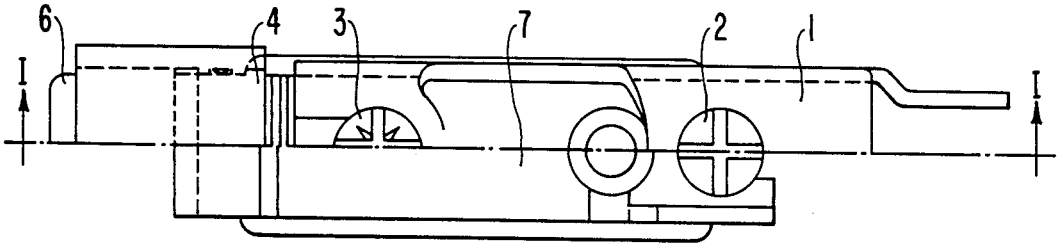
FIG. 2 is a top view thereof.

The invention parts which are not directly associated with the hinge, such as the hinge casing and the hinge links, are not shown in the drawings, since they are made in accordance with the state of the art.

DESCRIPTION OF THE PREFERRED EMBODIMENT

As can be seen from the drawings, the hinge parts which are essential to the present invention are a hinge arm 1, a mounting plate 7 and an intermediate member 4 which carries a pivot lever 6. The pivot lever 6 is acted upon by a leg spring 5. At the front, i.e. near the end which carries the bearings for the hinge links, a joint adjustment screw 2 is screwed into the hinge arm 1. A head 2' of joint adjusting screw 2 is engaged into a recess 8 of the mounting plate 7. At the rear end, the hinge arm 1 has an open slot 9. A clamping screw 3, by means of which the hinge arm 1 is clamped to the intermediate member 4, extends through open slot 9.

Said clamping screw 3 also serves for the depth adjustment. By loosening clamping screw 3 the hinge arm 1 can be displaced over the length of slot 9 and thus be adjusted in the direction of the depth of the piece of furniture. The adjustment in the direction of the breadth of the door joint is effected in a conventional manner by turning the joint adjusting screw.

The hinge arm 1 as well as the intermediate member 4 advantageously have U-shaped configurations.

The mounting plate 7 at its rear end is provided with a projection 10.

For mounting the hinge arm, the intermediate member 4 is held at the hinge arm 1 by means of the clamping screw 3. The hinge arm 1 is engaged on the mounting plate 7 by the joint adjusting screw 2 and then is pivoted backwards about this pivot bearing. Thus, hook 11 of the tensioning lever 6 engages behind the projection 10 of the mounting plate 7.

The tensioning lever 6, as can be seen from FIG. 1, is provided with a handle member. If the hinge arm 1 is to be taken off the mounting plate 7, it will be sufficient to lift such handle member, whereupon the tensioning lever 6 with its hook 11 is pivoted from the projection 10 of the mounting plate 7.

The hinge arm 1 can also be separated from the intermediate member 4 by releasing the clamping screw 3 and can then be mounted on a mounting plate by means of a clamping screw, as for example described in DE-OS No. 26 14 446.

As can be seen from FIG. 1, the intermediate member 4 is provided with a centering projection 12 which extends into a slot-shaped recess 13 in the mounting plate 7.

In the illustrated embodiment a hinge arm for a hinge having an opening angle of 180° is shown. It will be appreciated that the locking mechanism according to the present invention can also be provided for a hinge arm of a 90° hinge.

What is claimed is:

1. A hinge comprising:

a mounting plate having at a first end thereof a longitudinally extending slot and at an opposite second end a latching projection;

a hinge arm having opposite first and second ends;

an intermediate member connected to said second end of said hinge arm;

a joint adjusting screw threaded through said first end of said hinge arm and having a head end slidably received in said slot in said mounting plate, thereby defining a pivot axis about which said hinge arm and said intermediate member connected thereto can be pivoted with respect to said mounting plate to move said intermediate member toward said second end of said mounting plate;

a pivot lever pivotally mounted on said intermediate member and having latching means for engaging with said latching projection of said mounting plate when said intermediate member is moved toward said second end of said mounting plate; and spring means mounted on said intermediate member and acting on said pivot lever to move said pivot lever to a position such that said latching means thereof engages said latching projection of said mounting plate, thereby fastening said intermediate member and said hinge arm on said mounting plate in clamping engagement, said pivot lever being movable against the force of said spring means to release engagement between said latching means and said latching projection, whereby said intermediate means and said hinge arm again are pivotable about said pivot axis away from said mounting plate.

2. A hinge as clamied in claim 1, wherein said second end of said hinge arm has therein a longitudinally extending further slot, and further comprising a clamping screw extending through said further slot and threaded into said intermediate member, thereby adjustably connecting said intermediate member to said second end of said hinge arm.

3. A hinge as claimed in claim 2, wherein said further slot is open-ended at said second end of said hinge arm.

4. A hinge as claimed in claim 1, wherein said slot is openended at said first end of said mouting plate.

5. A hinge as claimed in claim 1, wherein said intermediate member includes a centering projection fitting into a recess in said mounting plate when said latching means and said latching projection are in engagement.

6. A hinge as claimed in claim 1, wherein said intermediate member includes portions covering outer and side portions of said pivot lever.

7. A hinge as claimed in claim 1, wherein said spring means comprises a torsion spring having respective legs acting on said intermediate member and said pivot lever.

* * * * *